US005706538A

United States Patent [19]

Walega

[11] Patent Number: 5,706,538

[45] Date of Patent: Jan. 13, 1998

[54] COMPOSITE BAND FOR USE IN A FOOTWEAR FORMING MACHINE

[75] Inventor: William Walega, Hollis, N.H.

[73] Assignee: International Shoe Machine Corporation, Nashua, N.H.

[21] Appl. No.: 685,780

[22] Filed: Jul. 24, 1996

Related U.S. Application Data

[63] Continuation of Ser. No. 190,963, Feb. 3, 1994, abandoned.

[51] Int. Cl.[6] ..... A43D 21/00

[52] U.S. Cl. ..... 12/14.4; 12/8.2

[58] Field of Search ..... 12/14.4, 14.3, 12/8.2, 10.5

[56] References Cited

U.S. PATENT DOCUMENTS

| | | | |
|---|---|---|---|
| 3,606,625 | 9/1971 | Ioannilli | 12/14.4 |
| 3,689,952 | 9/1972 | Dawson et al. | 12/14.4 |
| 4,246,673 | 1/1981 | Fichtner | 12/14.4 |
| 4,490,868 | 1/1985 | Becka | 12/14.4 |
| 4,553,281 | 11/1985 | Vornberger | 12/8.1 |

FOREIGN PATENT DOCUMENTS

| | | |
|---|---|---|
| 958213 | 5/1964 | United Kingdom . |
| 2018569 | 10/1979 | United Kingdom . |

*Primary Examiner*—B. Dayoan

*Attorney, Agent, or Firm*—Lowe, Price, LeBlanc & Becker

[57] ABSTRACT

A composite band for use in a lasting machine to wipe a portion of the margin of a footwear assembly onto the insole of the assembly that typically includes a last, a shoe upper on the last and an insole at the last bottom. The band includes an elastic (e.g., Teflon) footwear assembly engaging strip member to engage the upper of the footwear assembly during lasting to press the upper onto the last during lasting, the elastic footwear assembly engaging member having a T-slot extending longitudinally the length of the elastic footwear assembly engaging member and including a transverse slot member and a radial slot member. A metal strip disposed within the T-slot is dimensioned to fit snugly within the transverse slot member of the T-slot such that the metal strip can slide longitudinally within the transverse slot member of the T-slot of the elastic footwear assembly engaging member but is substantially unable to move either transversely or radially relative to the elastic shoe engaging member. At least three mechanical connectors are rigidly secured to the metal strip and further effect mechanical engagement of the metal strip to the elastic footwear assembly engaging strip member such that the metal strip at some regions thereof is restrained from movement in any direction relative to the strip member but at other regions it is able to move in the order of a few millimeters longitudinally relative to the strip member. Each mechanical connector includes a cylindrical aperture that serves to interconnect the respective connector in rotatable relationship with a cylindrical member of the lasting machine.

19 Claims, 5 Drawing Sheets

COMPOSITE BAND FOR USE IN A FOOTWEAR FORMING MACHINE

This application is a continuation of application Ser. No. 08/190,963 filed Feb. 3, 1994 now abandoned.

BACKGROUND OF THE INVENTION

The present invention relates to bands that are used in footwear forming machines.

Attention is called to U.S. Pat. No. 4,490,868 (Becka), hereby incorporated by reference herein, and the further art cited therein. The Becka patent discloses a composite band of the general type of the present invention, whose immediate use is in the context of toe lasting machines. Such a band is pivotally connected to the toe machine at the toe-end and at one or more places along a pair of legs extending heelward from the toe-end. The composite band, there and here, is subjected to flexing forces whereby, in the footwear forming process, it is repeatedly bent to conform to the shape of the footwear and then relaxes to an unflexed condition. During the flexing and relaxing the pivotal connectors along the legs of the composite band attempt to move longitudinally relative to other portions of the composite band, but are restrained from doing so by rivets in the Becka patent. It is an object of the present invention to obviate the need for such rivets and, hence, permit small relative longitudinal movements, as later discussed, within the composite band.

These and still further objects are addressed hereinafter.

The foregoing objectives are found in a composite band for use in a lasting machine to wipe a curvilinear portion (e.g., toe) of the margin of a footwear (e.g., shoe) assembly onto the insole of the shoe assembly that includes a last, a footwear upper on the last, which upper includes a margin that extends away from the last and the insole at the last bottom. The composite band includes a flexible footwear assembly engaging strip member having a curved section to wrap around the curvilinear portion of the footwear assembly during lasting and a pair of legs extending away from the curved section to engage contiguous parts of the footwear assembly during lasting to press the upper onto the last at the contiguous parts during lasting, the flexible footwear assembly engaging member having a T-slot extending longitudinally the length of the flexible footwear assembly engaging member. The T-slot includes a transverse slot member and a radial slot member. A flat metal strip, disposed within the T-slot, is dimensioned to fit snugly within the transverse slot member of the T-slot such that the metal strip can slide longitudinally within the transverse slot member of the T-slot of the flexible footwear assembly engaging member but is substantially unable to move either transversely or radially relative to the flexible footwear engaging member; and at least three mechanical connectors disposed to effect mechanical attachment of the metal strip to the elastic footwear assembly engaging strip member, including a first mechanical connector positioned at the curved section and operable to connect the metal strip to the flexible footwear assembly engaging strip member at the curvilinear position to prevent any substantial movement in any direction of the metal strip relative to the flexible footwear assembly engaging strip member at the toe region; a second mechanical connector operable to connect the metal strip to one leg of the pair of legs to permit small longitudinal movement only of the metal strip relative to the flexible shoe engaging strip at the one leg during lasting; and a third mechanical connector operable to connect the metal strip to the second leg of the pair of legs to permit small longitudinal movement only of the metal strip relative to the flexible shoe engaging strip at the second leg during lasting.

BRIEF CHARACTERIZATION OF THE DRAWING

The invention is hereinafter described with reference to the accompanying drawing in which.

Figure 1:
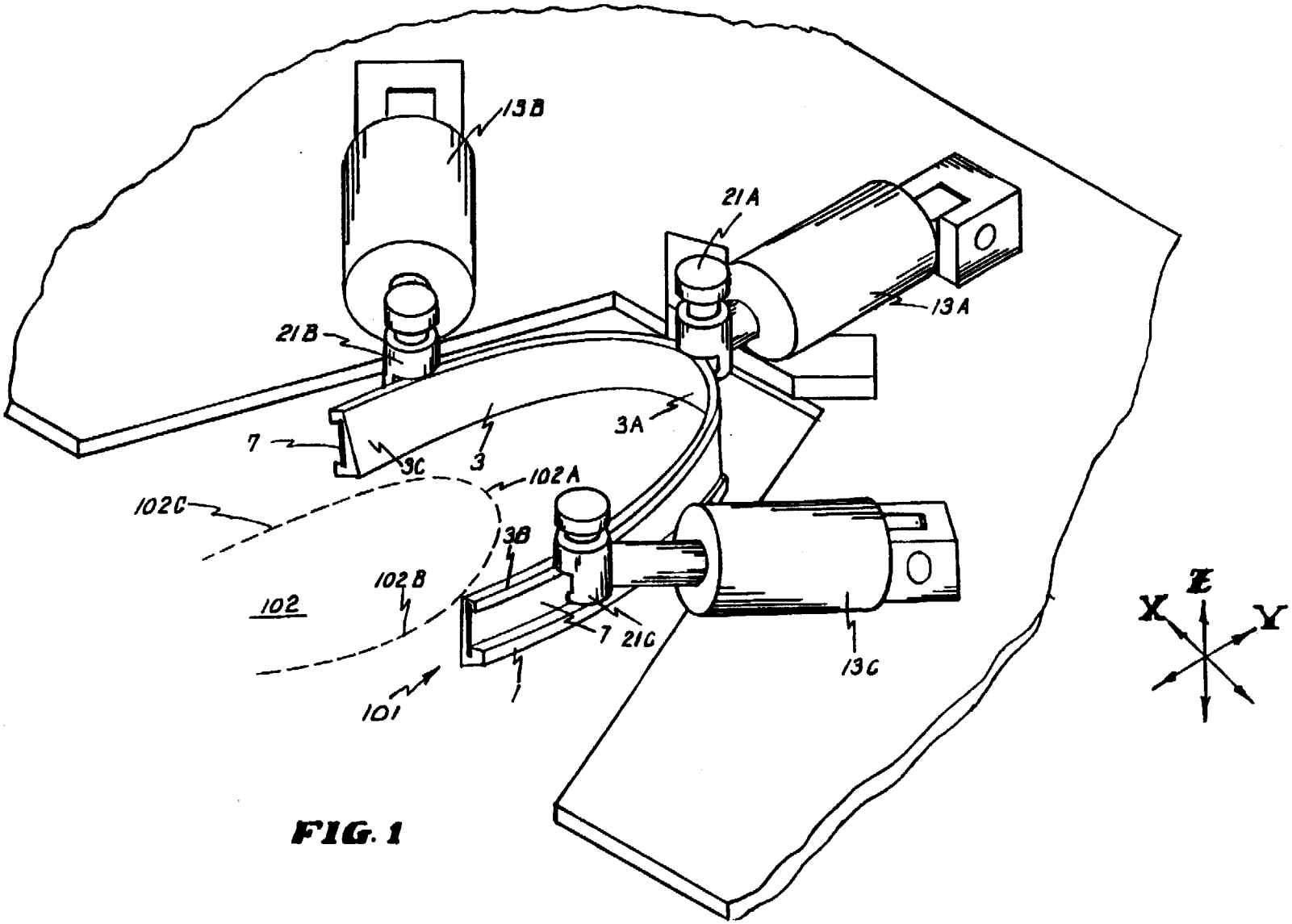
FIG. 1 is an isometric view showing parts of a toe lasting machine with a composite band of the present invention in its operative position within the machine.

Turning now to the drawing, a composite band is shown at 1 for use in a toe-lasting shoe machine 101 (for example), to wipe the toe end marked 102A, and contiguous sides 102B and 102C of a shoe assembly 102 that includes a last, a shoe upper on the last and an insole at the last bottom; see U.S. Pat. No. 4,553,281, Vornberger), hereby incorporated by reference herein, which shows one such shoe assembly.

Figure 4A:
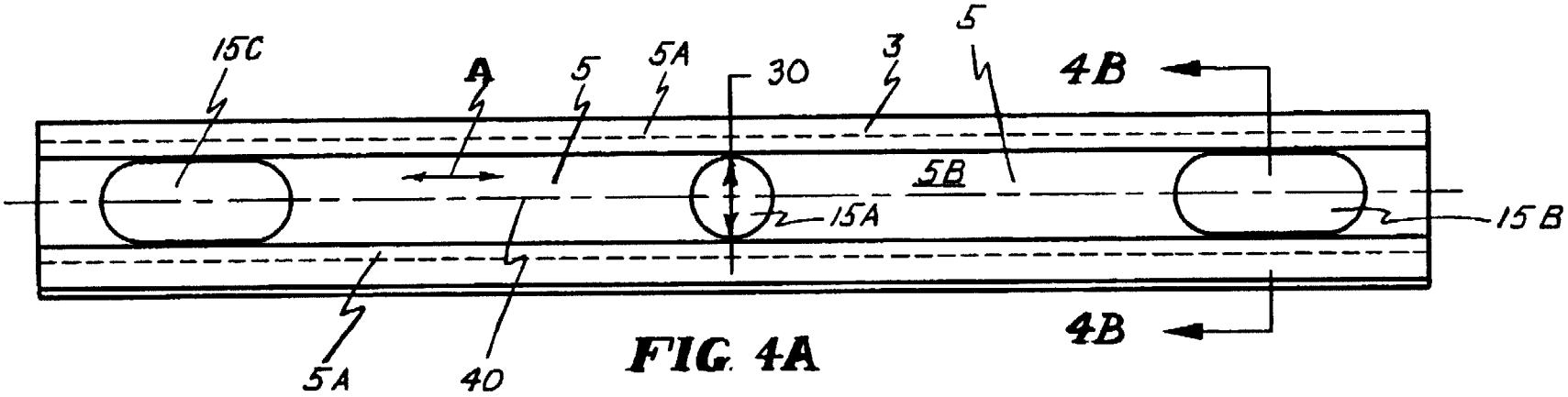
FIG. 4A shows in plan view a flexible footwear assembly engaging strip (e.g., Teflon) prior to being bent to the in situ shape in FIG. 1.

The composite band 1 includes an elastic, flexible, (e.g., Teflon) shoe engaging strip member 3 in FIG. 4A having a curved portion 3A in FIG. 1 to wrap around the toe end of the shoe assembly labeled 102 during lasting and a pair of legs 3B and 3C extending heelward away from the curved portion 3A to engage the respective sides 102B and 102C of the shoe assembly 102 during lasting to press the upper toward the shoe assembly 102 at the respective sides during lasting, the elastic shoe engaging member 3 having a T-slot 5 extending longitudinally axially the length of the elastic shoe engaging member and consisting of a transverse slot member 5A and a radial slot member 5B. The radial slot member 5B is in fact (see FIG. 4A) an elongated rectangular passage or channel.

Figure 4B:
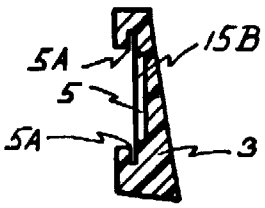
FIG. 4B is a view taken in the line 4B—4B in FIG. 4A, looking in the direction of the arrows.

A flat, rectilinear metal strip 7 is disposed within the T-slot 5 and is dimensioned to fit snugly within the T-slot such that the metal strip 7 can slide longitudinally (i.e., along the Y-axis; see axis 40 in FIG. 4A and arrow A) within the T-slot 5 of the elastic shoe engaging member 3 but is substantially unable to move either transversely or radially (i.e., orthogonal to the axis 40) relative to the elastic shoe engaging member 3. Said another way, the metal strip 7 in FIG. 5 when installed within the T-slot 5 in FIGS. 4A and 4B within the elastic shoe engaging strip member 3 in FIG. 4A can move only in the axial directions marked A in FIGS. 4A and 5, further subject to constraints imposed by the connector marked 9 in FIGS. 6A, 6B and 6C, as later discussed.

Figure 3:
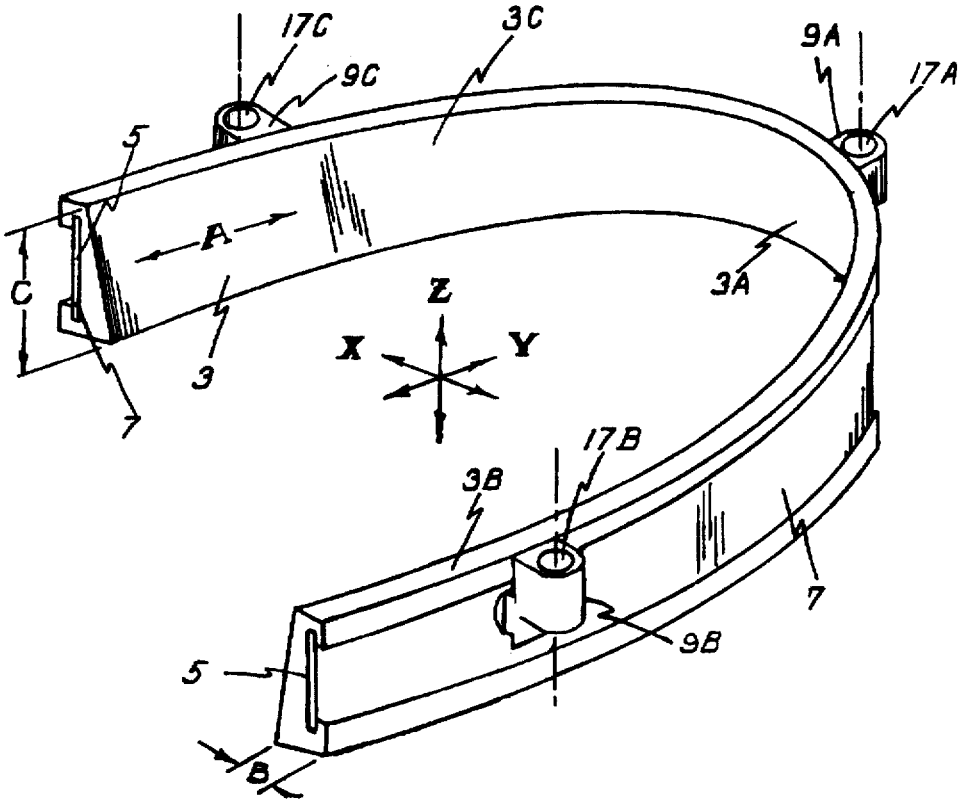
FIG. 3 is an isometric view of the composite band particularly to show connectors that serve to connect the composite band to the machine.

At least three identical mechanical connectors 9A, 9B and 9C in FIG. 3 (i.e., identical to the connector 9 in FIGS. 6A, 6B and 6C) disposed to effect mechanical attachment of the metal strip 7 to the elastic (and flexible) shoe engaging strip member 3 include a first mechanical connector 9A positioned at the toe (or toe region) 3B in FIG. 1 and operable to connect the metal strip 7 to the elastic (resinous-material) shoe engaging strip member 3 at the toe (or toe region) 3A to prevent any substantial movement in any direction of the metal strip relative to the elastic shoe engaging strip member 3 at 3A, a second mechanical connector 9B operable to connect the metal strip 7 to one leg 3B of the pair of legs to permit small longitudinal movement only of the metal strip relative to the elastic shoe engaging strip at the one leg 3B during lasting, and a third mechanical connector 9C operable to connect the metal strip 7 to the second leg 3C of the pair of legs to permit small longitudinal movement only of the metal strip 7 relative to the elastic shoe engaging strip at the second leg 3C during lasting.

The term longitudinal in the present context is the fore and aft direction labeled A in FIG. 3 relative to the axis (whether straight or curved) of the flexible shoe engaging strip member 3 to distinguish movement therealong from the transverse direction designated C in FIG. 3, that is, the thickness direction of the strip 3 in FIG. 3; the depth direction or thickness marked B in FIG. 3 is also termed the radial direction herein. Thus, the assembled composite band legs 3B and 3C pivot respectively counterclockwise and clockwise about the connector 9A at the toe region by forces exerted by air cylinders 13B and 13C, respectively to engage the upper assembly 102 and press the upper toward and onto the last. An air cylinder 13A moves the composite band 1 in the minus/plus Y-direction in FIG. 1 respectively to effect contact between the composite band 1 and the shoe upper assembly 102 and to discontinue such contact. The shoe upper assembly 102 is diagrammatic and is intended to show, as is well known, a last, a shoe upper on the last and an insole at the last bottom, all within the designation 102, as shown in the Vornberger patent.

The metal strip 7 has three identical apertures therethrough along its length, a toe aperture 11A and two leg apertures 11B and 11C, each aperture being rectangular with circular-cylindrical enlargements 14A, 14B and 14C intermediate the respective ends of each rectilinear aperture. The resinous-material shoe engaging strip 3 has three depressions 15A, 15B and 15C in FIG. 4A, the first of which registers with the elongate toe aperture 11A of the rectilinear metal strip 7, the second of which 15B registers with one of the two leg apertures (i.e., the aperture 11B) of the rectilinear metal strip 7 and the third of which 15C registers with the second of the two leg apertures (i.e., the aperture 11C) of the rectilinear metal strip 7. The second depression 15B and the third depression 15C are rectangular and have cross dimensions (i.e., in the direction orthogonal to the direction of the arrow A in FIG. 5) "substantially" equal to the length labeled 30 in FIGS. 5 and 6C of the apertures 11A, 11B and 11C to permit longitudinal movement of the metal strip 7 relative to the resinous material shoe engaging strip 3 due to mechanical deformation of the composite band 1 during lasting.

Figure 2:
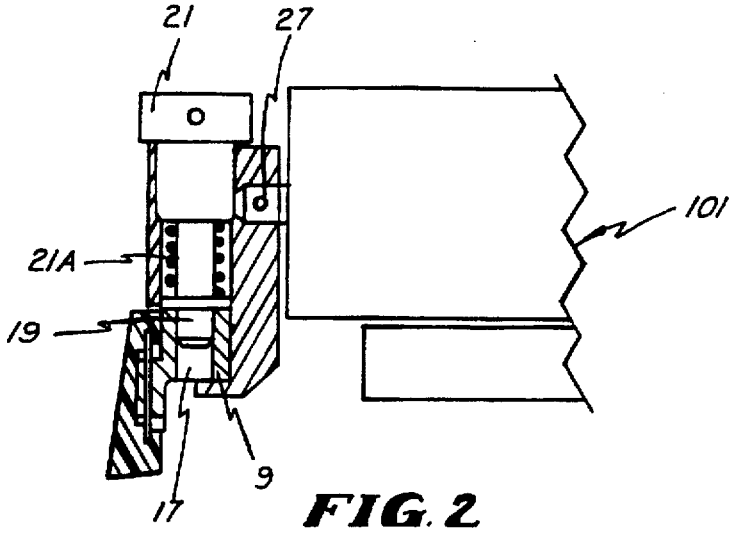
FIG. 2 is an elevation view of a small portion of the composite band and closely positioned machine parts to show details of attachment of the composite band to the machine.
Figure 6A:
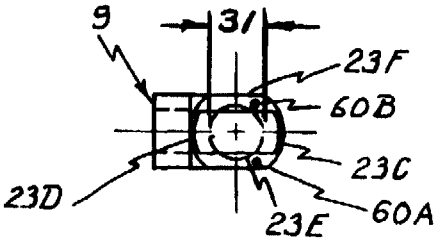
FIG. 6A, FIG. 6B and FIG. 6C are respectively a plan view, an elevation and a side view of a connector of the type shown in other figures.
Figure 6C:
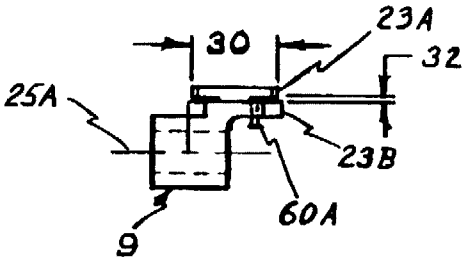
Figure 6B:
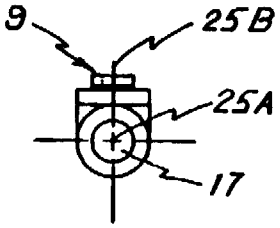
Figure 7:
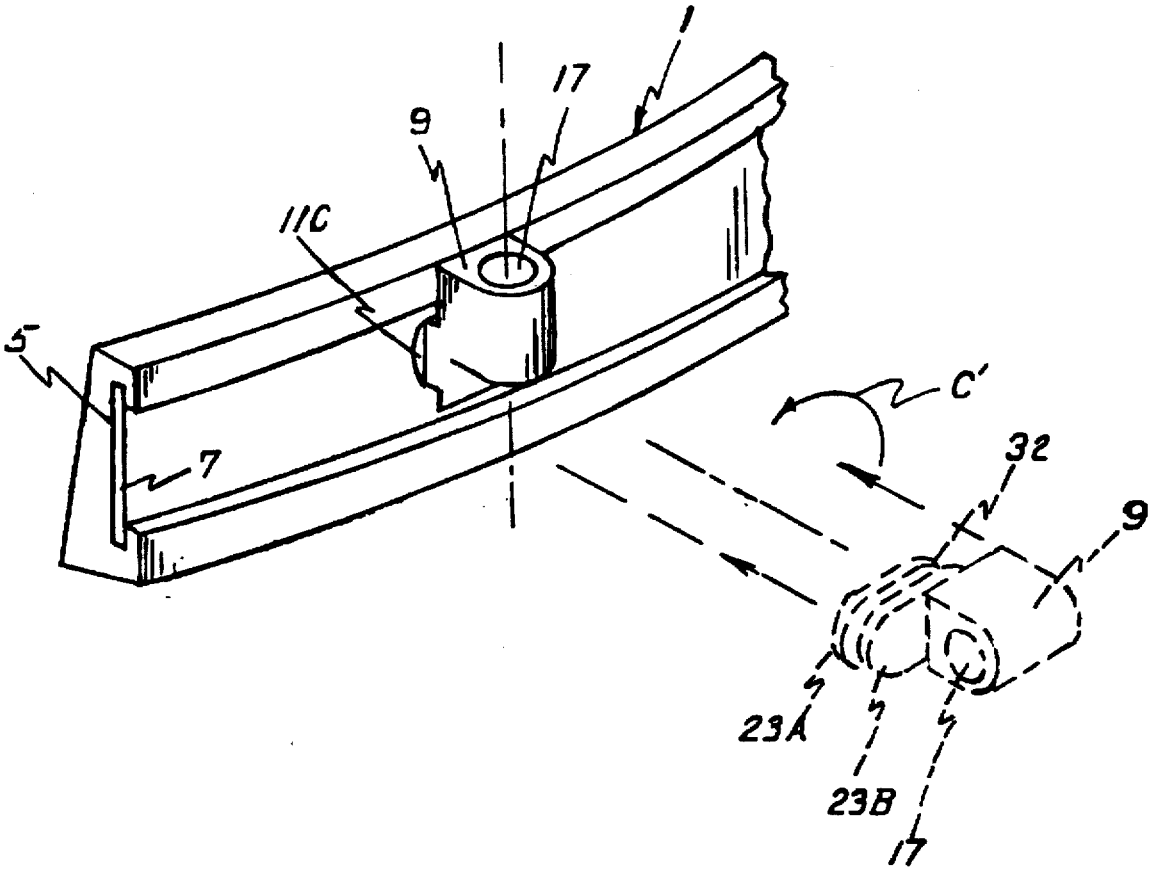
FIG. 7 is an isometric view (slightly enlarged) of a portion of the composite band in FIG. 1.

All the connectors 9A-9C are installed in the same way as the connector 9 in FIG. 7 which shows a portion of the composite band 1 in earlier figures with the connector 9 shown in phantom prior to installation and solid after installation. The phantom connector 9 is received by the aperture 11C in FIG. 7 and rotated through 90 degrees counterclockwise (see arrow C') such that the gap labeled 32 in FIGS. 7 and 6C receives the thickness of the metal strip 7 to interlock the strip 7 and the connector 9. Each connector 9 has a cylindrical aperture 17 (i.e., 17A, 17B and 17C in FIG. 3) to receive a cylindrical shaft 19 in FIG. 2 from a quick disconnect mechanism 21 (21A, 21B and 21C in FIG. 1 to permit facile connect/disconnect of the composite band 1 to the toe machine 101, the respective shaft 19 permitting pivoting of the band 1 relative to the quick disconnect mechanism. The labels 13A, 13B and 13C denote air cylinders that serve to energize the band during lasting. In this explanation it will be appreciated that the connector 9 in FIGS. 6A, 6B and 6C has a different orientation than the same connector (in phantom) in FIG. 7. Thus the connector 9 in FIG. 6C might be received by the aperture 11A in FIG. 5 and would be rotated clockwise through 90 degrees to lock in place. A spring 21A applied downward force on the shaft 19 against a lock pin 27.

Figure 5A:
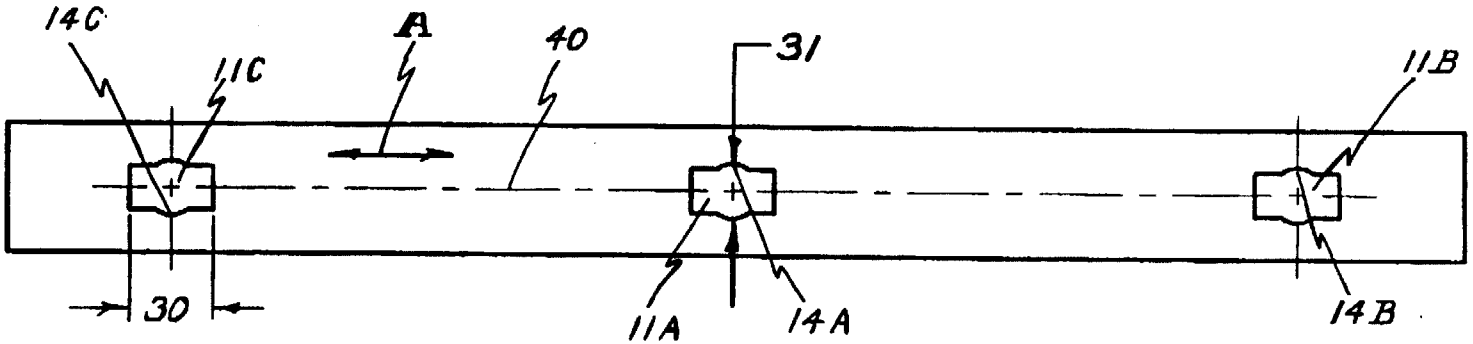
FIG. 5A shows in plan view a perforated flat metal strip positioned within a T-slot in the composite band of earlier figures.
Figure 5B:
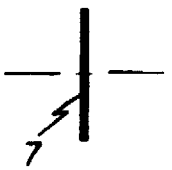
FIG. 5B is an end view of the flat metal strip in FIG. 5A.

The dimension 31 in FIG. 6A is "substantially" the same as the diameter of the respective enlargement 14A or 14B or 14C in FIG. 5. The gap dimension 32 in FIG. 6C is "substantially" equal to the thickness of the strip 7 and is the dimension of the gap between two closely-spaced plates 23A and 23B (one of which is positioned outward from the other) having two parallel sides 23E and 23F that are longer than the other two sides (i.e., the arcuate ends 23C and 23D). The plates 23A and 23B are mechanically interconnected and rigidly relatively positioned as a rigid body by a mechanical structure (e.g., one piece, unitary structure) which effects movement of the mechanical structure 9 as a rigid body As noted above, each mechanical connector 9 has a cylindrical extension (the plate 23A) whose axis 25B is orthogonal to the axis marked 25A of the cylindrical aperture 17 in the connector. The cylindrical extension (the plate 23A ) is received by the corresponding depression 15A or 15B or 15C in the resinous strip 3 such that each mechanical connector can be introduced into an appropriate aperture in the metal strip 7 and then rotated through ninety degrees (see the arrow in FIG. 7), as above noted, effectively to mechanically rigidly secure the particular connector 9 to the metal strip 7 and provide pivoting connection between the particular connector 9 and the lasting machine 101. The elongate depressions 15B and 15C to receive the particular extension 23A to permit some longitudinal movement of the strip 7 relative to the resinous strip 3, particularly at the leg regions 3B and 3C of the composite band 3. The driving air cylinders 13B and 13C have non-rotatable drive shafts (to prevent band twisting to present forces so the bottom of the band) which can be accomplished by using a non-circular drive shaft, for example, by rods that secure the drive shaft—rotationally—to the body of the particular drive cylinder. (Such non-rotatable drive shaft cylinders are commercially available.) The small screws shown at 60A and 60B of FIG. 6A maintain the associated connector 9 in place when the associated drive cylinder is not attached thereon.

Modifications of the invention herein disclosed will occur to persons skilled in the art and all such modifications are deemed to be with the scope of the invention as defined by the appended claims.

What is claimed is:

1. A composite band for use in a lasting shoe machine that serves to wipe the top and contiguous sides of a shoe assembly, comprising:

a flexible resinous-material shoe engaging strip member having a curved portion to wrap around the toe of the shoe during lasting and a pair of legs extending away from the curved portion to engage the respective sides of the shoe assembly during lasting to press the upper inward at said respective sides during lasting, said resinous-material shoe engaging member having a T-slot extending longitudinally the length of the resinous shoe engaging member and comprising walls defining a transverse slot and walls defining a radial slot;

a flat, rectilinear metal strip disposed within the T-slot and dimensioned to fit snugly within the T-slot such that the metal strip can slide longitudinally within the T-slot of the resinous-material show engaging member but is substantially unable to move either transversely or radially relative to the resinous-material shoe engaging member; and at least three mechanical connectors disposed to effect mechanical attachment of the metal strip to the lasting machine, including a first mechanical connector positioned at the toe region and operable to operatively connect the metal strip to the resinous-material shoe engaging strip member at the toe region to prevent any substantial translational movement in any direction of the metal strip relative to the resinous-material shoe engaging strip member, a second mechanical connector operable to connect the metal strip to the lasting machine proximate one leg of the pair of legs to permit small longitudinal movement only of the metal strip relative to the elastic shoe engaging strip at said one leg during lasting, and a third mechanical connector operable to connect the metal strip to the lasting machine proximate the second leg of the pair of legs to permit small longitudinal movement only of the metal strip relative to the resinous-material shoe engaging strip at said second leg during lasting;

said flat, rectilinear metal strip having three identical elongated apertures therethrough along its length, a toe aperture and two leg apertures, each aperture being elongate with cylindrical enlargements intermediate the ends of each aperture;

said resinous-material shoe engaging strip having three depressions, the first of which is circular and registers with the toe aperture of the rectilinear metal strip, the second of which registers with one of the two leg apertures of the rectilinear metal strip and the third of which registers with the second of the two leg apertures of the rectilinear metal strip;

said second of which depression and said third of which depression being elongate and having cross dimensions equal to the length of the apertures in the metal strip to permit longitudinal movement of the metal strip relative to the resinous-material shoe engaging strip due to mechanical deformation of the composite band during lasting;

each of the mechanical connectors having a cylindrical aperture to receive a cylindrical shaft from a quick disconnect mechanism to permit facile connect/disconnect of the composite band to said toe machine, which shaft permits pivoting of the band relative to the quick disconnect mechanism;

each of the mechanical connectors having two closely spaced rectilinear plates with arcuate ends, that is, said rectilinear plates having two parallel sides that are longer than the other two sides, mechanically interconnected and rigidly relatively positioned as a rigid body by a mechanical structure which effects movement of each said mechanical connector as a rigid body, each of the mechanical connectors having a cylindrical extension whose axis is orthogonal to the axis of said cylindrical aperture and which is received by the corresponding depression in the resinous-material shoe engaging strip such that each said mechanical connector can be introduced into an appropriate aperture in the metal strip and then be rotated through ninety degrees effectively to mechanically rigidly secure the mechanical connector to the metal strip and provide a pivoting connection between the mechanical connector and the lasting machine.

2. A composite band for use in a lasting machine to wipe a curvilinear portion of a margin of a footwear assembly onto an insole of the footwear assembly that includes a last, a shoe upper on a last, which upper includes said margin that extends away from the last, and said insole at a last bottom, comprising:

an elastic footwear assembly engaging strip member having a curved section to wrap around the curvilinear portion of the footwear assembly during lasting and a pair of legs extending away from the curved section to engage contiguous parts of the footwear assembly during lasting to press the upper inwardly at said contiguous parts during lasting, said elastic footwear assembly engaging strip member having a T-slot extending longitudinally the length of the elastic footwear assembly engaging member and comprising a transverse slot member and a radial slot member;

a metal strip substantially entirely disposed within the T-slot and dimensioned to fit snugly within the transverse slot member of the T-slot such that the metal strip can slide longitudinally within the T-slot of the elastic footwear assembly engaging strip member but is substantially unable to move either transversely or radially relative to the elastic footwear assembly engaging strip member; and at least three mechanical connectors disposed to effect mechanical attachment of the metal strip to the lasting machine and comprising a first mechanical connector positioned at the curved section and operable to enable the metal strip to interact with the elastic footwear assembly engaging strip member at the curved section to prevent any substantial movement at said curved section in any direction of the metal strip relative to the elastic footwear assembly engaging strip member, a second mechanical connector operable to connect the metal strip to the lasting machine proximate one leg of the pair of legs to permit small longitudinal movement only of the metal strip relative to the elastic footwear assembly engaging strip member at said one leg during lasting, and a third mechanical connector operable to connect the metal strip to the lasting machine proximate the second leg of the pair of legs to permit small longitudinal movement only of the metal strip relative to the elastic footwear assembly engaging strip member at said second leg during lasting.

3. A composite band for use in a lasting shoe machine to wipe toe and contiguous sides of a shoe assembly, comprising:

a polytetrafluoroethylene elastic shoe engaging strip having a curved portion to wrap around the toe of the shoe assembly during lasting and a pair of legs extending away from the curved portion to engage respective sides of the shoe assembly during lasting to press said respective sides inward during lasting, said shoe engaging strip having a T-slot extending longitudinally the length of the shoe engaging strip and comprising a transverse slot and a radial slot;

a metal strip substantially entirely disposed within the T-slot and dimensioned to fit snugly within the T-slot such that the metal strip can slide longitudinally within the T-slot of the shoe engaging strip but is unable by constraint of the T-slot to move either transversely or radially relative to the elastic shoe engaging member; and at least three mechanical connectors disposed to effect mechanical attachment of to the metal strip to the lasting machine, comprising a first mechanical connector positioned at a toe region and operable to enable the metal strip to interact with the shoe engaging strip at the toe region to prevent any substantial translational movement there in any direction of the metal strip relative to the shoe engaging strip, a second mechanical connector operable to interconnect the metal strip to the lasting machine proximate one leg of the pair of legs to permit small longitudinal movement only of the metal strip relative to the shoe engaging strip at said one leg during lasting, and a third mechanical connector operable to interconnect the metal strip to the lasting machine proximate the second leg of the pair of legs to permit small longitudinal movement only of the metal strip relative to the shoe engaging strip at said second leg during lasting.

4. A composite band according to claim 3 in which the T-slot includes an open elongated rectangular area which provides access to a central circular depression at said toe region, to receive the first mechanical connector, an elongated depression at said one leg to receive the second mechanical connector configured to permit said small longitudinal movement of the one leg and another elongated depression at said second leg to receive the third mechanical connector configured to permit said small longitudinal movement at the second leg between the metal strip and the shoe engaging strip.

5. A composite band according to claim 4 in which each said mechanical connector is a unitary rigid-body structure which has two closely spaced rectilinear plates having two parallel sides which are longer than two other sides thereof, there being a gap between the rectilinear plates about equal to the thickness of the metal strip such that in the composite band when assembled, the metal strip is received at each aperture therein by the gap in the connector located at said each aperture to provide rigid mechanical connection of the respective connector to the metal strip, each connector being adapted to receive a shaft of a spring loaded button latch to effect connection of the composite band to the lasting shoe machine.

6. A composite band according to claim 5 in which the two closely-spaced rectilinear plates are mechanical rigidly secured to each other by a short shaft whose diameter is larger than a width of the rectilinear plates but which has a flat at each side which renders a cross dimension of the shaft equal to a length of said other two sides, such that, when each connector is properly positioned and rotated through ninety degrees the connector shaft enters the cutout and serves to lock the connector to the metal strip at the aperture to prevent longitudinal movement thereof.

7. A composite band for use in a lasting shoe machine to wipe a toe and contiguous sides of a shoe assembly, comprising:

a polytetrafluoroethylene shoe engaging strip having a curved section to wrap around the toe of the shoe assembly during lasting and a pair of legs extending away from the curved section to engage the contiguous sides of the shoe assembly during lasting to press an upper at said contiguous sides during lasting, said shoe engaging strip having a T-slot extending longitudinally the length of the shoe engaging strip and comprising a transverse slot and a radial slot;

a flat metal strip substantially entirely disposed within the T-slot and dimensioned to fit snugly within the T-slot such that the flat metal strip can slide longitudinally within the T-slot of the shoe engaging strip but is substantially unable to move either transversely or radially relative to the elastic shoe engaging member; and at least three mechanical connectors secured to the flat metal strip and disposed to effect mechanical interconnection of the flat metal strip to the lasting machine, comprising a first mechanical connector positioned at a toe region and operable to enable the flat metal strip to interact with the shoe engaging strip at the toe region to prevent any substantial movement in any translational direction of the flat metal strip relative to the shoe engaging strip, a second mechanical connector operable to interconnect the flat metal strip to the lasting machine proximate one leg of the pair of legs to permit small longitudinal movement of the flat metal strip relative to the shoe engaging strip at said one leg during lasting, and a third mechanical connector operable to interconnect the flat metal strip to the lasting machine proximate the second leg of the pair of legs to permit small longitudinal movement only of the flat metal strip relative to the shoe engaging strip at said second leg during lasting.

8. A composite band according to claim 7 in which the shoe engaging strip has a central circular depression at the curved section and an elongated depression at each leg of the pair of legs and in which the flat metal strip has three identical apertures along its length, one aperture registering with the central circular depression in the shoe engaging strip and the other two apertures registering respectively with one of each elongated depression.

9. A composite band according to claim 8 in which each of the three mechanical connectors is identical to the other two mechanical connectors, in which each connector includes a cylindrical cavity to receive a cylindrical shaft of a releasable button latch operable to secure the connector to the lasting machine.

10. A composite band according to claim 9 in which each said connector also includes two integral spaced flat plates having major surfaces parallel to an axis of the cylindrical cavity associated therewith and having a gap between the plates about equal to the thickness of the flat metal strip, and in which the ends of the plates are arcuate with a diameter slightly smaller than said central circular depression.

11. A composite band according to claim 10 in which each of three identical apertures in the flat metal strip is rectangular in cross dimensions with long sides of the rectangle parallel to a flat metal strip axis being larger than sides orthogonal to the flat metal strip axis and with a circular cutout intermediate the long sides of the rectangle.

12. A composite band according to claim 11 in which the diameter of each circular cutout is slightly larger than the diameter of rounded ends of the plates, the assembled parts of the composite band being secured together thusly when the flat metal strip is positioned within the T-slot with the apertures in the metal strip registering with the depression in the shoe engaging strip and each mechanical connector is introduced to a respective aperture in the metal strip, pressed appropriately to position the plates of the connector in depth relative to the metal strip and then each said mechanical connector is revolved through ninety degrees to cause the gap in the plates of connector to receive the flat metal strip and connect the flat metal strip to the connector and hence connect the shoe engaging strip to the connector.

13. A composite band according to claim 7 wherein said mechanical connectors are structured to interconnect the composite band and the lasting machine.

14. A composite band for use in a lasting machine that serves to wipe a toe and contiguous sides of a shoe assembly, comprising:

a flexible resinous-material shoe engaging strip having a curved portion to wrap around the toe of the shoe assembly during lasting and a pair of legs extending away from the curved portion to engage the respective sides of the shoe assembly during lasting to press an upper inward at said respective sides during lasting, said shoe engaging strip having a T-slot extending longitudinally the length of the shoe engaging strip and comprising walls defining a transverse slot and walls defining a radial slot; and a metal strip substantially entirely disposed within the T-slot and dimensioned to fit snugly within the T-slot such that the metal strip can slide longitudinally within the T-slot of the resinous-material shoe engaging strip but is substantially unable to move either transversely or radially relative to the resinous-material shoe engaging strip.

15. A composite band according to claim 14 that further includes at least three mechanical connectors disposed to effect mechanical attachment of the metal strip to the lasting machine comprising a first mechanical connector positioned at a toe region and operable to enable the metal strip to interact with the resinous-material shoe engaging strip at the toe region to prevent any substantial translational movement in any direction of the metal strip relative to the resinous-material shoe engaging strip, a second mechanical connector operable to connect the metal strip to the lasting machine proximate one leg of the pair of legs to permit small longitudinal movement only of the metal strip relative to the shoe engaging strip at said one leg during lasting, and a third mechanical connector operable to connect the metal strip to the lasting machine proximate the second leg of the pair of legs to permit small longitudinal movement only of the metal strip relative to the resinous-material shoe engaging strip at said second leg during lasting;

said metal strip having three identical elongated apertures therethrough along its length, a toe aperture and two leg apertures, each aperture being elongate with cylindrical enlargements intermediate ends of each aperture.

16. A composite band according to claim 15 in which said resinous-material shoe engaging strip has three discrete depressions, the first of which registers with the toe aperture of the metal strip, the second of which registers with one of the two leg apertures of the metal strip and the third of which registers with the second of the two leg apertures of the metal strip, said first of which depression being circular, said second of which depression and said third of which depression being elongate to permit longitudinal movement of the metal strip relative to the resinous material shoe engaging strip by virtue of mechanical deformation of the composition band during lasting, each of the mechanical connectors having a cylindrical aperture to receive a cylindrical shaft from a quick disconnect mechanism to permit facile connect/disconnect of the composite band to said machine, which shaft permits pivoting of the band relative to the quick disconnect mechanism, each of the mechanical connectors having two closely spaced rectilinear plates, one outward from the other, with arcuate ends that is, said rectilinear plates having two parallel sides that are longer than the other two sides, mechanically interconnected and rigidly relatively positioned as rigid body by a mechanical structure which effects movement of each said mechanical connector as a rigid body, each of the mechanical connectors having a cylindrical extension, i.e., the outward plate, whose axis is orthogonal to an axis of said cylindrical aperture and which is received by the corresponding depression in the resinous-material shoe engaging strip such that each said mechanical connector can be introduced into an appropriate aperture in the metal strip and then be rotated through ninety degrees effectively to mechanically rigidly secure the particular connector to the metal strip and provide a pivoting connection between the particular connector and the lasting machine.

17. A composite band for use in a lasting machine to wipe a curvilinear portion of the margin of a footwear assembly onto an insole of a shoe assembly that includes a last, a shoe upper on the last, which upper includes said margin that extends away from the last, and said insole at a last bottom, comprising:

an elastic footwear assembly engaging strip having a curved section to wrap around the curvilinear portion of the footwear assembly during lasting and a pair of legs extending away from the curved section to engage contiguous parts of the footwear assembly during lasting to press the upper inwardly at said contiguous parts during lasting, said elastic footwear assembly engaging strip having a T-slot extending longitudinally substantially the length of the elastic footwear assembly engaging strip and comprising a transverse slot member and a radial slot member; and a metal strip substantially entirely disposed within the T-slot and dimensioned to fit snugly within the transverse slot member of the T-slot such that the metal strip can slide longitudinally within the T-slot of the elastic footwear assembly engaging strip but is substantially unable to move either transversely or radially relative to the elastic footwear assembly engaging strip.

18. The composite band of claim 17 that further includes at least three mechanical connectors disposed to effect mechanical attachment of the metal strip to the lasting machine comprising a first mechanical connector mechanically secured to and positioned at the curved section and operable to enable the metal strip to interact with the elastic footwear assembly engaging strip at the curvilinear portion to prevent any substantial translational movement at said curved portion in any direction of the metal strip relative to the elastic footwear assembly engaging strip, a second mechanical connector operable to connect the metal strip to the lasting machine proximate one leg of the pair of legs to permit small longitudinal movement only of the metal strip relative to the elastic shoe engaging strip at said one leg during lasting, and a third mechanical connector operable to connect the metal strip to the lasting machine proximate the second leg of the pair of legs to permit small longitudinal movement only of the metal strip relative to the elastic footwear assembly engaging strip at said second leg during lasting.

19. A composite band for use in a lasting machine to wipe a curvilinear portion of the margin of a footwear assembly onto an insole of a shoe assembly that includes a last, a shoe upper on the last, which upper includes said margin that extends away from the last, and said insole at a last bottom, comprising:

an elastic footwear assembly engaging strip having a curved section to wrap around the curvilinear portion of the footwear assembly during lasting and a pair of legs extending away from the curved section to engage contiguous parts of the footwear assembly during lasting to press the upper inwardly at said contiguous parts during lasting, said elastic footwear assembly engaging strip having a slot extending longitudinally substantially the length of the elastic footwear assembly engaging strip and comprising at least a transverse slot member and a radial slot member; and a metal strip substantially entirely disposed within the slot and being mounted to slide in the longitudinal direction of the slot of the elastic foot assembly engaging the strip without substantial movement either transversely or radially relative to the elastic footwear assembly engaging strip; and at least three mechanical connectors disposed to effect mechanical attachment of the metal strip and thereby the elastic footwear assembly engaging strip to said lasting machine.

* * * * *